US008371816B2

(12) United States Patent
Piersall et al.

(10) Patent No.: US 8,371,816 B2
(45) Date of Patent: Feb. 12, 2013

(54) ROTOR BLADES FOR TURBINE ENGINES

(75) Inventors: Matthew R. Piersall, Greenville, SC (US); Brian D. Potter, Greer, SC (US)

(73) Assignee: General Electric Company, Schenectady, NY (US)

( * ) Notice: Subject to any disclaimer, the term of this patent is extended or adjusted under 35 U.S.C. 154(b) by 672 days.

(21) Appl. No.: 12/533,378

(22) Filed: Jul. 31, 2009

(65) Prior Publication Data

US 2011/0027088 A1 Feb. 3, 2011

(51) Int. Cl.
*F01D 1/00* (2006.01)

(52) U.S. Cl. ..... 416/190; 416/191; 416/192; 416/500

(58) Field of Classification Search ..... 416/190, 416/191, 192, 195, 196 R, 500
See application file for complete search history.

(56) References Cited

U.S. PATENT DOCUMENTS

| | | | | |
|---|---|---|---|---|
| 3,751,183 | A | 8/1973 | Nichols et al. | |
| 3,918,842 | A | 11/1975 | Longley et al. | |
| 3,986,792 | A * | 10/1976 | Warner | 416/190 |
| 4,088,421 | A | 5/1978 | Hoeft | |
| 4,182,598 | A | 1/1980 | Nelson | |
| 4,243,360 | A * | 1/1981 | Wright | 416/191 |
| 4,441,859 | A | 4/1984 | Sadler | |
| 4,917,574 | A | 4/1990 | Dodd et al. | |
| 4,936,749 | A | 6/1990 | Arrao et al. | |
| 5,083,903 | A * | 1/1992 | Erdmann | 416/190 |
| 5,201,850 | A | 4/1993 | Lenhardt et al. | |
| 5,313,786 | A | 5/1994 | Chlus et al. | |
| 5,730,584 | A | 3/1998 | Dodd | |
| 5,924,699 | A | 7/1999 | Airey et al. | |
| 6,164,916 | A * | 12/2000 | Frost et al. | 416/189 |
| 6,283,707 | B1 | 9/2001 | Chin | |
| 6,341,941 | B1 * | 1/2002 | Namura et al. | 416/190 |
| 6,776,583 | B1 | 8/2004 | Sims et al. | |
| 6,851,932 | B2 | 2/2005 | Lagrange et al. | |
| 7,001,152 | B2 * | 2/2006 | Paquet et al. | 416/190 |
| 7,066,713 | B2 * | 6/2006 | Dube et al. | 415/173.5 |
| 7,396,205 | B2 * | 7/2008 | Dube et al. | 415/173.5 |
| 7,628,587 | B2 * | 12/2009 | McFeat et al. | 416/189 |
| 7,762,779 | B2 * | 7/2010 | Zemitis et al. | 416/191 |
| 2008/0019835 | A1 * | 1/2008 | McFeat et al. | 416/189 |
| 2008/0038116 | A1 * | 2/2008 | Zemitis et al. | 416/191 |
| 2008/0145207 | A1 * | 6/2008 | Mohr et al. | 415/173.1 |

FOREIGN PATENT DOCUMENTS

JP 54135906 A * 10/1979

* cited by examiner

*Primary Examiner* — Edward Look
*Assistant Examiner* — Christopher R Legendre
(74) *Attorney, Agent, or Firm* — Mark E. Henderson; Ernest G. Cusick; Frank A. Landgraff

(57) ABSTRACT

A tip shroud that includes a plurality of damping fins, each damping fin including a substantially non-radially-aligned surface that is configured to make contact with a tip shroud of a neighboring rotor blade. At least one damping fin may include a leading edge damping fin and at least one damping fin may include a trailing edge damping fin. The leading edge damping fin may be configured to correspond to the trailing edge damping fin.

18 Claims, 7 Drawing Sheets

ROTOR BLADES FOR TURBINE ENGINES

This invention was made with Government support under Contract No. DE-FC26-05NT42643 awarded by the Department of Energy. The Government has certain rights in the invention.

BACKGROUND OF THE INVENTION

The present application relates generally to apparatus, methods and/or systems concerning the design and operation of turbine rotor blades. More specifically, but not by way of limitation, the present application relates to apparatus, methods and/or systems pertaining to turbine blade tip shrouds with damping and other features.

In a gas turbine engine, it is well known that air pressurized in a compressor is used to combust a fuel in a combustor to generate a flow of hot combustion gases, whereupon such gases flow downstream through one or more turbines so that energy can be extracted therefrom. In accordance with such a turbine, generally, rows of circumferentially spaced turbine rotor blades extend radially outwardly from a supporting rotor disk. Each blade typically includes a dovetail that permits assembly and disassembly of the blade in a corresponding dovetail slot in the rotor disk, as well as an airfoil that extends radially outwardly from the dovetail and interacts with the flow of the working fluid through the engine. The airfoil has a generally concave pressure side and generally convex suction side extending axially between corresponding leading and trailing edges and radially between a root and a tip. It will be understood that the blade tip is spaced closely to a radially outer turbine shroud for minimizing leakage therebetween of the combustion gases flowing downstream between the turbine blades.

As one of ordinary skill in the art will appreciate, due to various stimulus sources during engine operation, rotor blades often exist in a state of vibration or resonance. The sources of vibration generally include rotational imbalance, stator blade stimulus, unsteady pressure perturbations, and combustion acoustic tones. The resulting vibration generally results in the accrual of high cycle fatigue damage, which typically shortens the life of the rotor blade and, in cases where the fatigue causes a blade failure during operation, may lead to catastrophic damage to the turbine engine. The magnitude of the vibration is related at least in part to the amount of damping that is introduced into the system. The more damping that is introduced, the lower the vibratory response, and the more reliable the turbine system becomes. As such, there is a continuing need for improved apparatus, system, and methods for damping and, thereby, reducing the vibration experienced by the rotor blades of turbine engine during operation.

BRIEF DESCRIPTION OF THE INVENTION

The present application thus describes a tip shroud that includes a plurality of damping fins, each damping fin comprising a substantially non-radially-aligned surface that is configured to make contact with a tip shroud of a neighboring rotor blade. At least one damping fin comprises a leading edge damping fin and at least one damping fin comprise a trailing edge damping fin; and the leading edge damping fin corresponds to the trailing edge damping fin.

The present application further describes a tip shroud for a turbine rotor blade that includes a plurality of damping fins, each damping fin comprising a substantially non-radially-aligned contact surface that is configured to make contact with a tip shroud of a neighboring rotor blade. At least one damping fin may comprise a leading edge damping fin and at least one damping fin may comprise a trailing edge damping fin. The leading edge damping fin and the trailing edge damping fin may be configured such that when a set of rotor blades having tip shrouds of the same design are installed in a rotor disk of the turbine engine, the leading edge damping fin of a first rotor blade engages the trailing edge damping fin of a second rotor blade that directly leads the first rotor blade and the trailing edge damping fin of the first rotor blade engages the leading edge damping fin of a third rotor blade that directly trails the first rotor blade. The radial position of the leading edge damping fin may be offset from the radial position of the trailing edge damping fin such that a desired level of contact between the substantially non-radially-aligned contact surface of the leading edge damping fin and the substantially non-radially-aligned contact surface of the trailing edge damping fin is maintained during operation of the turbine engine.

These and other features of the present application will become apparent upon review of the following detailed description of the preferred embodiments when taken in conjunction with the drawings and the appended claims.

BRIEF DESCRIPTION OF THE DRAWINGS

These and other features of this invention will be more completely understood and appreciated by careful study of the following more detailed description of exemplary embodiments of the invention taken in conjunction with the accompanying drawings, in which.

DETAILED DESCRIPTION OF THE INVENTION

Figure 1:
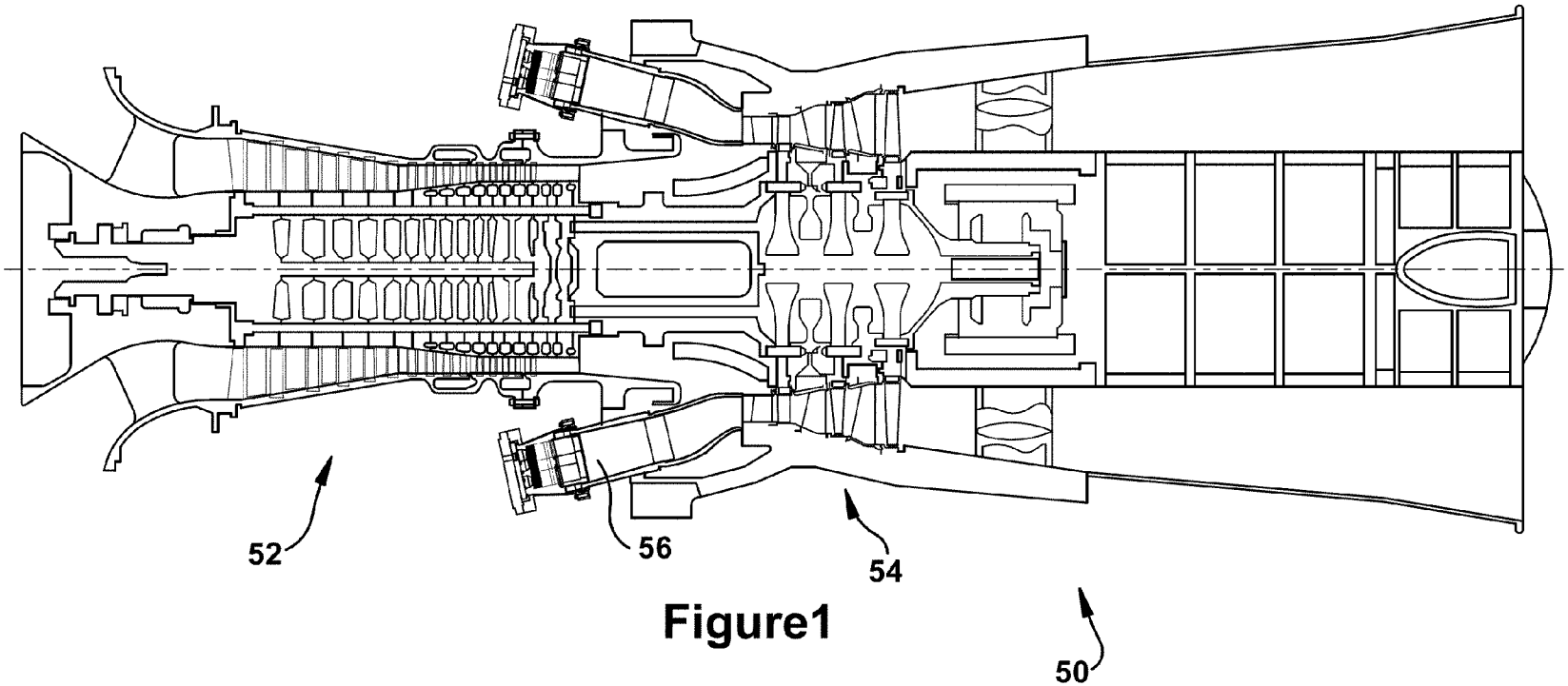
FIG. 1 is a schematic representation of an exemplary gas turbine engine in which embodiments of the present application may be used.

As an initial matter, to communicate clearly the invention of the current application, it may be necessary to select terminology that refers to and describes certain parts or machine components of a turbine engine. Whenever possible, common industry terminology will be used and employed in a manner consistent with its accepted meaning. However, it is meant that any such terminology be given a broad meaning and not narrowly construed such that the meaning intended herein and the scope of the appended claims is unreasonably restricted. Those of ordinary skill in the art will appreciate that often a particular component may be referred to using several different terms. In addition, what may be described herein as a single part may include and be referenced in another context as consisting of several component parts, or, what may be described herein as including multiple component parts may be fashioned into and, in some cases, referred to as a single part. As such, in understanding the scope of the invention described herein, attention should not only be paid to the terminology and description provided, but also to the structure, configuration, function, and/or usage of the component, as provided herein.

In addition, several descriptive terms may be used regularly herein, and it may be helpful to define these terms at this point. These terms and their definition given their usage herein is as follows. The term "rotor blade", without further specificity, is a reference to the rotating blades of either the compressor 52 or the turbine 54, which include both compressor rotor blades 60 and turbine rotor blades 66. The term "stator blade", without further specificity, is a reference the stationary blades of either the compressor 52 or the turbine 54, which include both compressor stator blades 62 and turbine stator blades 68. The term "blades" will be used herein to refer to either type of blade. Thus, without further specificity, the term "blades" is inclusive to all type of turbine engine blades, including compressor rotor blades 60, compressor stator blades 62, turbine rotor blades 66, and turbine stator blades 68. Further, as used herein, "downstream" and "upstream" are terms that indicate a direction relative to the flow of working fluid through the turbine. As such, the term "downstream" refers to a direction that generally corresponds to the direction of the flow of working fluid, and the term "upstream" generally refers to the direction that is opposite of the direction of flow of working fluid. The terms "trailing" and "leading" generally refers relative position in relation to the direction of rotation for rotating parts. As such, the "leading edge" of a rotating part is the front or forward edge given the direction that the part is rotating and, the "trailing edge" of a rotating part is the aft or rearward edge given the direction that the part is rotating. The term "radial" refers to movement or position perpendicular to an axis. It is often required to described parts that are at differing radial positions with regard to an axis. In this case, if a first component resides closer to the axis than a second component, it may be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis.

Figure 2:
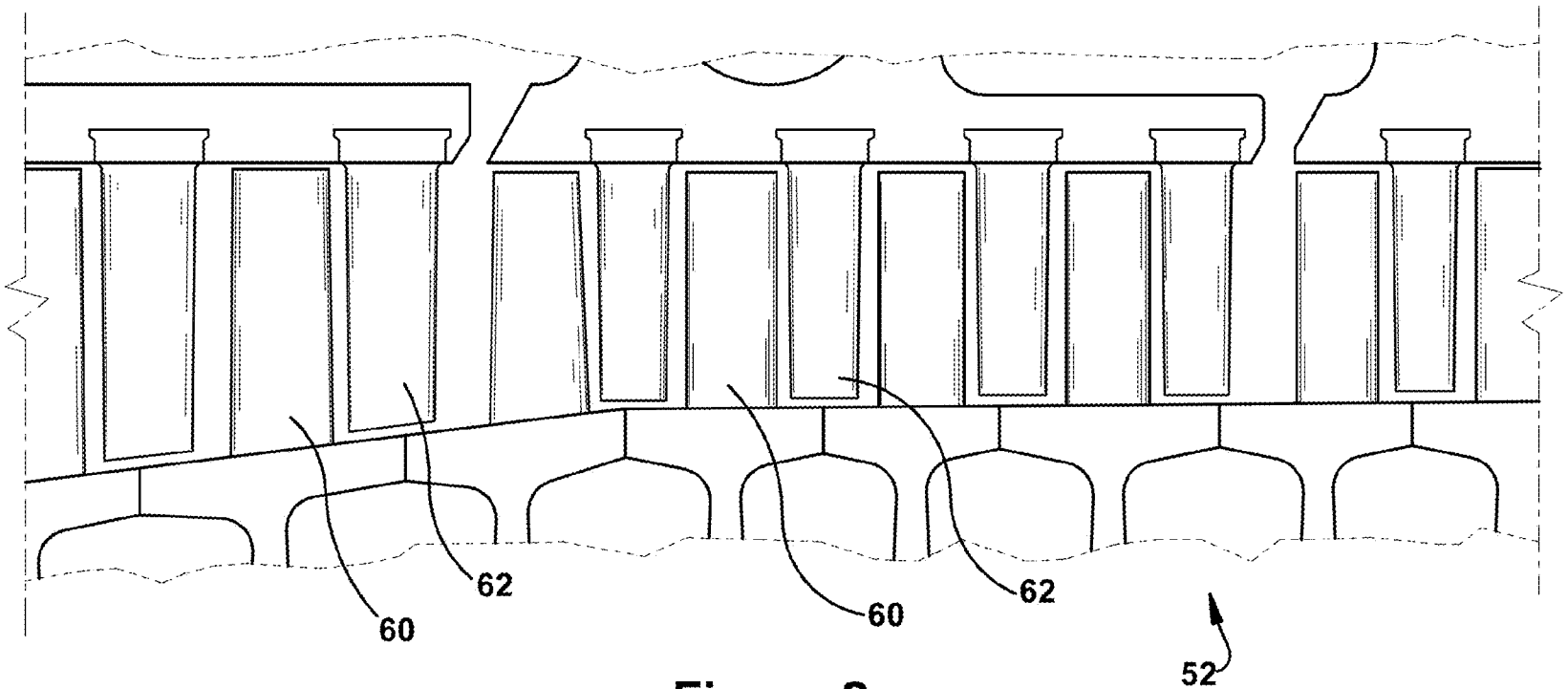
FIG. 2 is a sectional view of the compressor in the gas turbine engine of FIG. 1.
Figure 3:
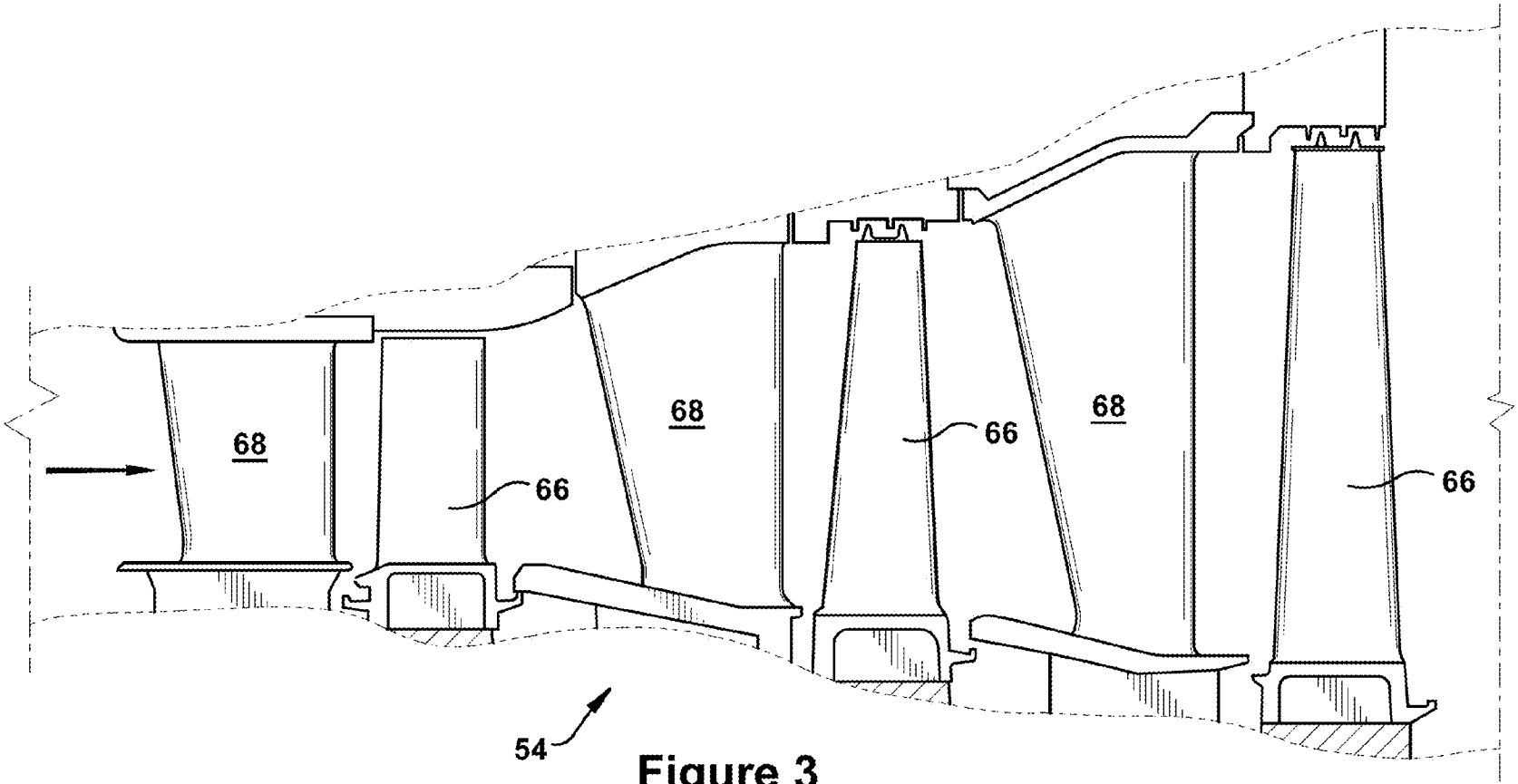
FIG. 3 is a sectional view of the turbine in the gas turbine engine of FIG. 1.

By way of background, referring now to the figures, FIGS. 1 through 3 illustrate an exemplary gas turbine engine in which embodiments of the present application may be used. It will be understood by those skill in the art that the present invention is not limited to this type of usage. As stated, the present invention may be used in gas turbine engines, such as the engines used in power generation and airplanes, steam turbine engines, and other type of rotary engines. FIG. 1 is a schematic representation of a gas turbine engine 50. In general, gas turbine engines operate by extracting energy from a pressurized flow of hot gas produced by the combustion of a fuel in a stream of compressed air. As illustrated in FIG. 1, gas turbine engine 50 may be configured with an axial compressor 52 that is mechanically coupled by a common shaft or rotor to a downstream turbine section or turbine 54, and a combustor 56 positioned between the compressor 52 and the turbine 56.

FIG. 2 illustrates a view of an exemplary multi-staged axial compressor 52 that may be used in the gas turbine engine of FIG. 1. As shown, the compressor 52 may include a plurality of stages. Each stage may include a row of compressor rotor blades 60 followed by a row of compressor stator blades 62. Thus, a first stage may include a row of compressor rotor blades 60, which rotate about a central shaft, followed by a row of compressor stator blades 62, which remain stationary during operation. The compressor stator blades 62 generally are circumferentially spaced one from the other and fixed about the axis of rotation. The compressor rotor blades 60 are circumferentially spaced and attached to the shaft; when the shaft rotates during operation, the compressor rotor blades 60 rotate about it. As one of ordinary skill in the art will appreciate, the compressor rotor blades 60 are configured such that, when spun about the shaft, they impart kinetic energy to the air or fluid flowing through the compressor 52. The compressor 52 may have other stages beyond the stages that are illustrated in FIG. 2. Additional stages may include a plurality of circumferential spaced compressor rotor blades 60 followed by a plurality of circumferentially spaced compressor stator blades 62.

FIG. 3 illustrates a partial view of an exemplary turbine section or turbine 54 that may be used in the gas turbine engine of FIG. 1. The turbine 54 also may include a plurality of stages. Three exemplary stages are illustrated, but more or less stages may present in the turbine 54. A first stage includes a plurality of turbine buckets or turbine rotor blades 66, which rotate about the shaft during operation, and a plurality of nozzles or turbine stator blades 68, which remain stationary during operation. The turbine stator blades 68 generally are circumferentially spaced one from the other and fixed about the axis of rotation. The turbine rotor blades 66 may be mounted on a turbine wheel (not shown) for rotation about the shaft (not shown). A second stage of the turbine 54 also is illustrated. The second stage similarly includes a plurality of circumferentially spaced turbine stator blades 68 followed by a plurality of circumferentially spaced turbine rotor blades 66, which are also mounted on a turbine wheel for rotation. A third stage also is illustrated, and similarly includes a plurality of turbine stator blades 68 and rotor blades 66. It will be appreciated that the turbine stator blades 68 and turbine rotor blades 66 lie in the hot gas path of the turbine 54. The direction of flow of the hot gases through the hot gas path is indicated by the arrow. As one of ordinary skill in the art will appreciate, the turbine 54 may have other stages beyond the stages that are illustrated in FIG. 3. Each additional stage may include a row of turbine stator blades 68 followed by a row of turbine rotor blades 66.

In use, the rotation of compressor rotor blades 60 within the axial compressor 52 may compress a flow of air. In the combustor 56, energy may be released when the compressed air is mixed with a fuel and ignited. The resulting flow of hot gases from the combustor 56, which may be referred to as the working fluid, is then directed over the turbine rotor blades 66, the flow of working fluid inducing the rotation of the turbine rotor blades 66 about the shaft. Thereby, the energy of the flow of working fluid is transformed into the mechanical energy of the rotating blades and, because of the connection between the rotor blades and the shaft, the rotating shaft. The mechanical energy of the shaft may then be used to drive the rotation of the compressor rotor blades 60, such that the necessary supply of compressed air is produced, and also, for example, a generator to produce electricity.

Figure 4:
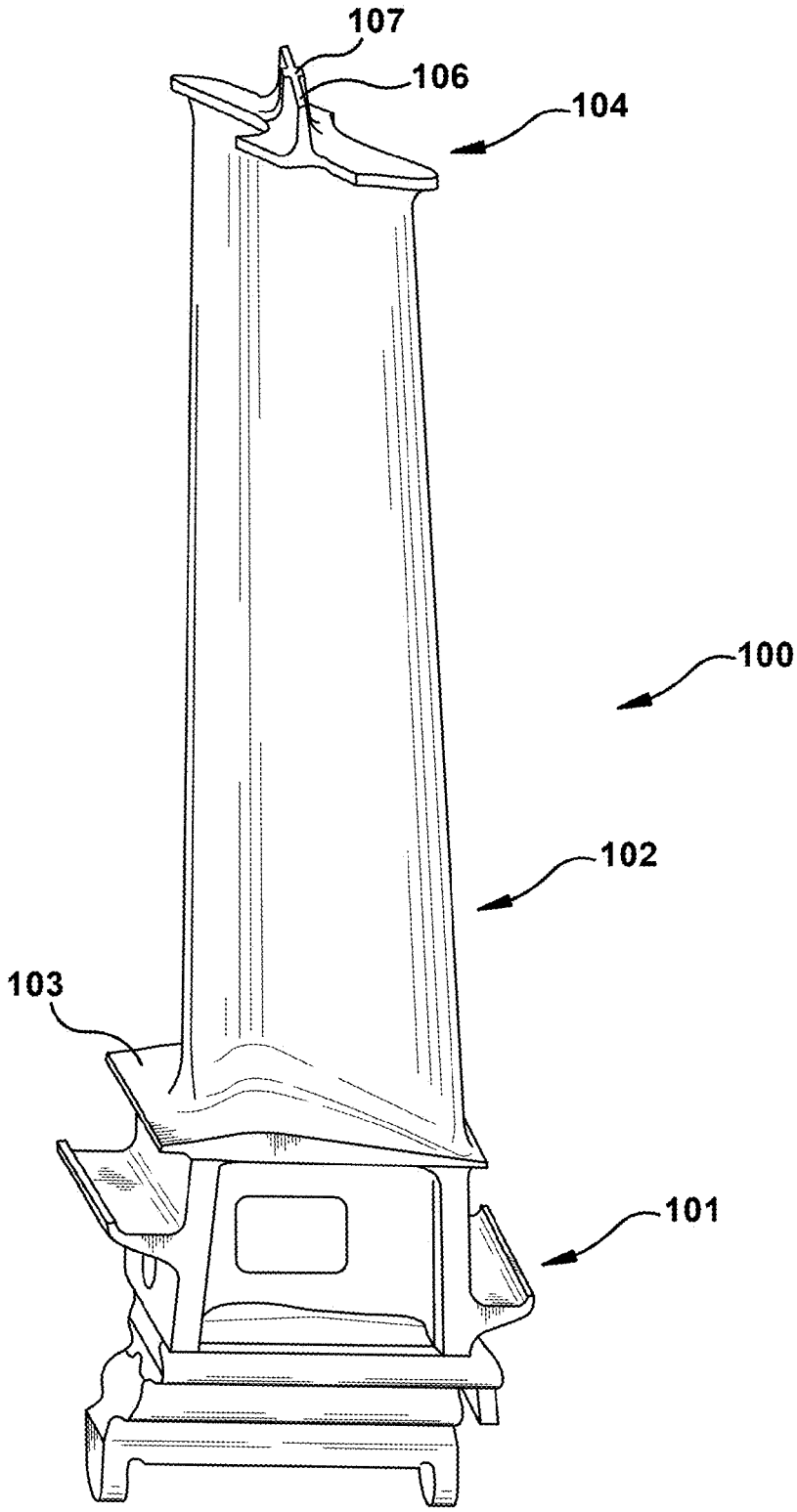
Figure 4 (Prior Art)
FIG. 4 is a perspective view of an exemplary gas turbine engine rotor blade having a tip shroud of conventional design.
Figure 5:
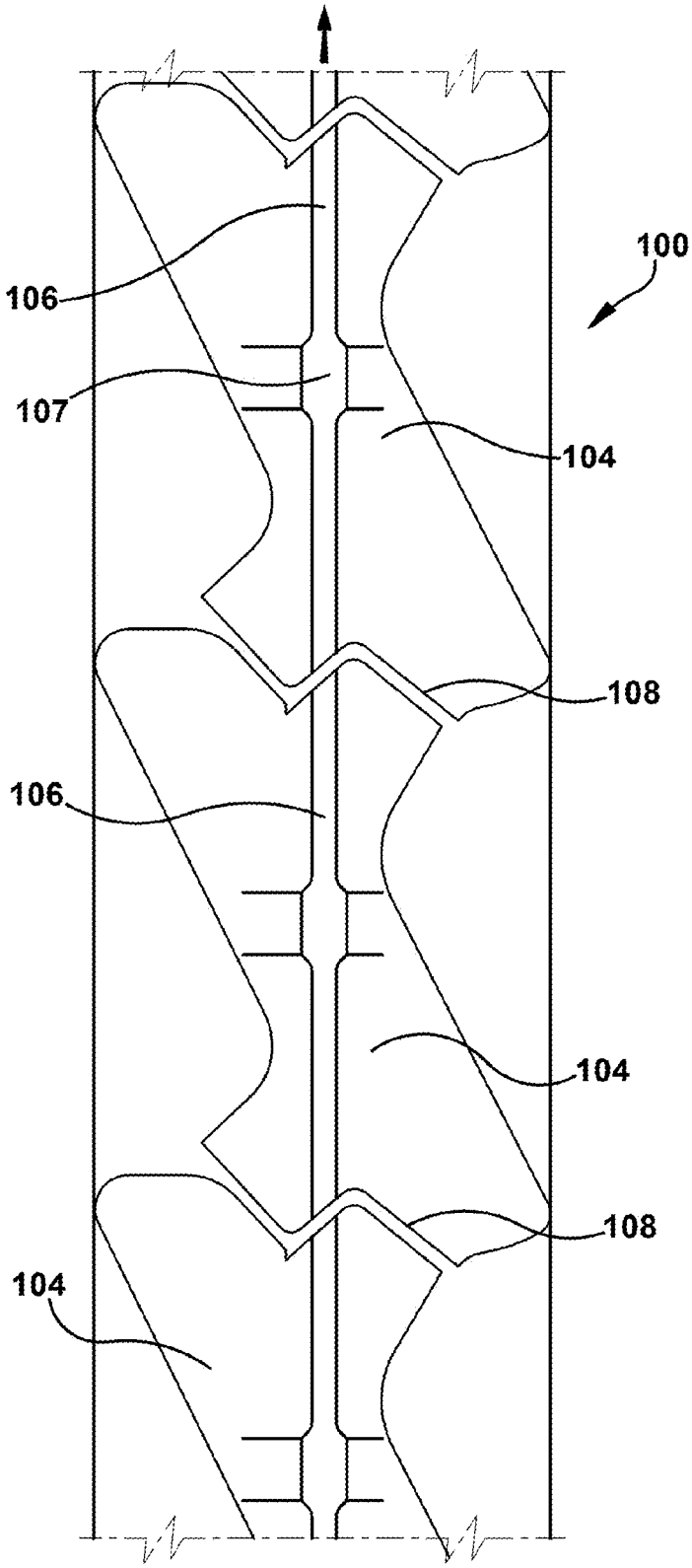
Figure 5 (Prior Art)
FIG. 5 is an outboard view of a series of installed turbine blades having a tip shrouds of conventional design.

FIGS. 4 and 5 illustrate a tip shrouded turbine rotor blade 100 according to conventional design. The turbine rotor blade 100 includes a dovetail 101 which may have any conventional form, such as an axial dovetail configured for being mounted in a corresponding dovetail slot in the perimeter of the rotor disk. An airfoil 102 is integrally joined to the dovetail 101 and extends radially or longitudinally outwardly therefrom. The rotor blade 100 also includes a platform 103 disposed at the junction of the airfoil 102 and the dovetail 101 for defining a portion of the radially inner flowpath through the turbine engine. The airfoil 102 is the active component of the blade 100 that intercepts the flow of the working fluid.

A tip shroud 104 may be positioned at the top of the airfoil 102. The tip shroud 104 essentially is an axially and circumferentially extending flat plate that is supported towards its center by the airfoil 102. Positioned along the top of the tip shroud 104 may be a seal rail 106. Generally, the seal rail 106 projects radially outward from the outer radial surface of the tip shroud 104. The seal rail 106 generally extends circumferentially between opposite ends of the tip shroud in the general direction of rotation. The seal rail 106 is formed to deter the flow of working fluid through the gap between the tip shroud 104 and the inner surface of the surrounding stationary components. In some conventional designs, the seal rails 106 extend into an abradable stationary honeycomb shroud that opposes the rotating tip shroud 104. Typically, for a variety of reasons, a cutter tooth 107 may be disposed toward the middle of the seal rail 106 so as to cut a groove in the honeycomb of the stationary shroud that is slightly wider than the width of the seal rail 106.

Tip shrouds 104 may be formed such that the tip shrouds 104 of neighboring blades make contact during operation. FIG. 5 illustrates an outboard view of turbine rotor blades as they might appear when assembled on a turbine rotor disk and provides an example of a conventional arrangement where neighboring tip shrouds 104 make contact with each other during operation. Two full neighboring tip shrouds are shown with an arrow indicating the direction of rotation. As depicted, the trailing edge of the leading tip shroud 104 may contact or come in close proximity to the leading edge of the trailing tip shroud 104. This area of contact is often generally referred to as an interface or contact face 108, or, more particularly, given the configuration of the example provided, a Z-interface 108. As shown from the perspective of FIG. 5, the Z-interface 108 may be so-named because of the approximate "Z" shaped profile between the two edges of the neighboring tip shrouds 104. Those of ordinary skill in the art will appreciate that the use of the turbine blade 100 and the tip shroud 104 are exemplary only and that other turbine blades and tip shrouds of different configurations may be used with alternative embodiments of the current application. Further, the use of a "Z" shaped interface is exemplary only.

When the turbine is in a non-operating or startup "cold" state, as illustrated, a narrow space may exist at the contact face (or Z-interface) 108 between the edges of adjacent tip shrouds 104. When the turbine is operating in a "hot" state, the expansion of the turbine blade metal and the "untwist" of the airfoil may cause the gap to narrow such that the edges of adjacent tip shrouds 104 make contact. Other operating conditions, including the high rotation speeds of the turbine and the related vibration, may cause contact between adjacent tip shrouds 104, even where a gap in the contact face 108 partially remains during turbine operation. One of the functions of the contact made between neighboring tip shrouds 104 is to damp the system and, thereby, reduce vibration. However, conventional tip shroud design fails to adequately address much of the vibration that occurs through the operating turbine engine system. As stated, this vibration may damage or weaken the rotor blades and other components over time. One of the primary reasons for this deficiency is that, given conventional configuration, the neighboring tip shrouds 104 make limited contact with each other and, when contact is made, it is between substantially radially aligned surfaces and, thus, generally limited to one plane. Contact of this nature may be effective at damping vibration occurring along a single corresponding axis, but is largely ineffective at damping vibration occurring along multiple axes, which generally is the case in most turbine engine operating environments.

Figure 6:
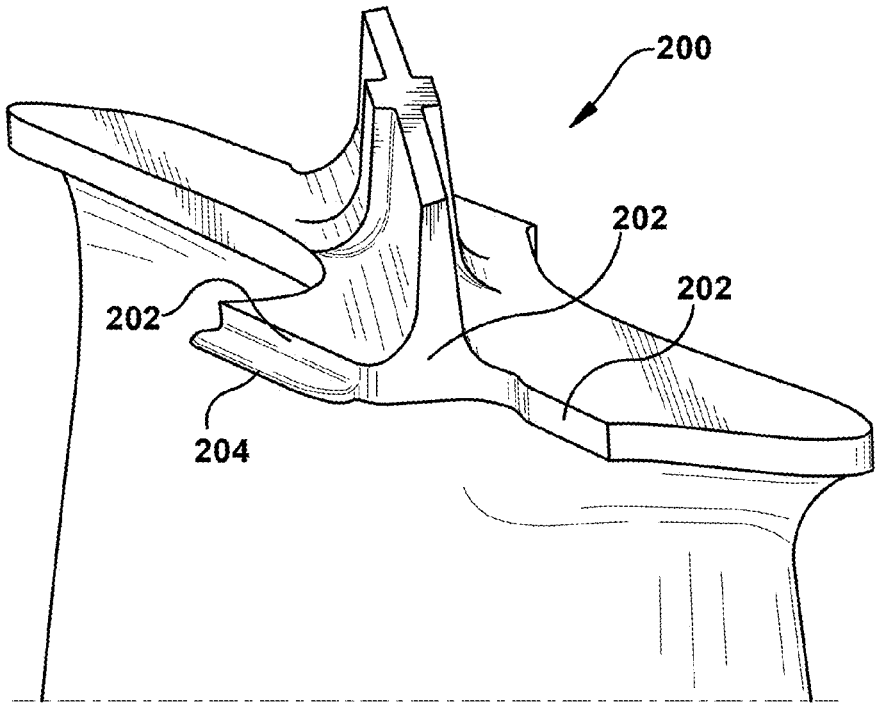
FIG. 6 is a perspective view of the leading edge of a turbine engine rotor blade having a tip shroud and a damping fin according to an exemplary embodiment of the present application.
Figure 7:
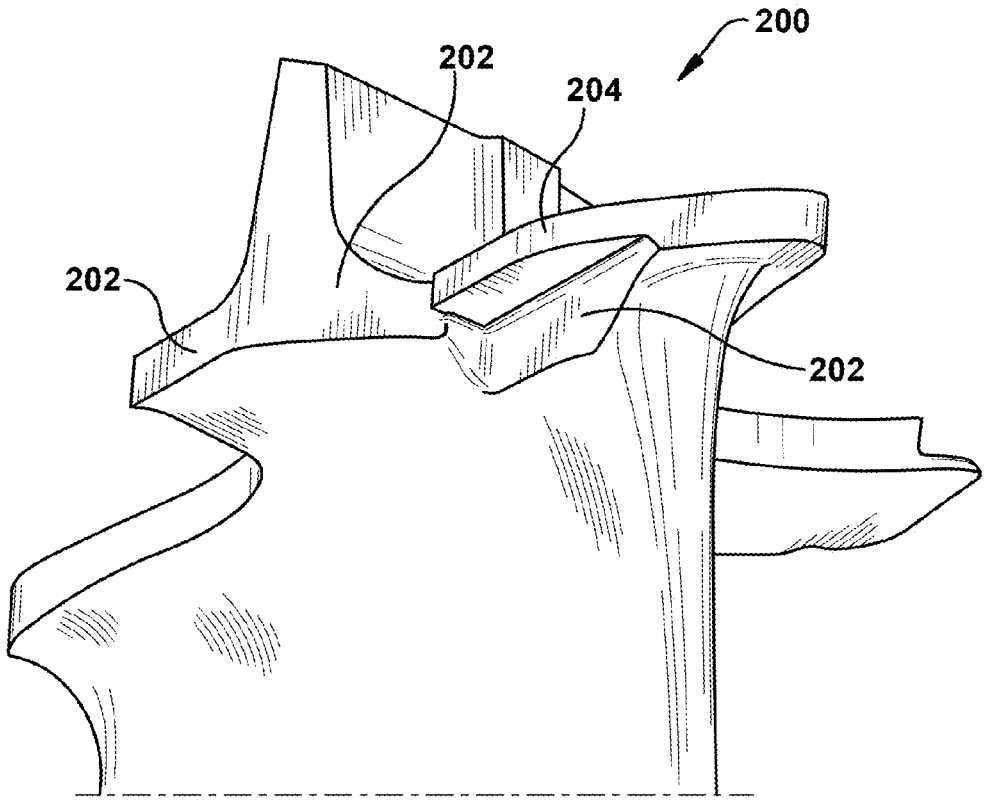
FIG. 7 is a perspective view of the trailing edge of the turbine engine rotor of FIG. 6 having a tip shroud and corresponding damping fin according to an exemplary embodiment of the present application.

FIGS. 6 and 7 illustrate an exemplary embodiment of the claimed invention, a tip shroud 200. As will be appreciated, FIG. 6 illustrates the leading edge of the tip shroud 200, while FIG. 7 illustrates the trailing edge. The tip shroud 200 may have a first contact surface or radially-aligned contact surface 202. The radially-aligned contact surface 202 refers to one or more contact surfaces (i.e., surfaces configured to make contact with the tip shrouds of neighboring rotor blades) that are aligned approximately in the radial direction. As one of ordinary skill in the art will appreciate, this primarily includes the surface toward the middle of the tip shroud 200 that extends radially outward along the seal rail 106. The radially-aligned contact surface 202 may also include any radially-aligned contact surfaces, including those that extend outward from the middle of the tip shroud 200 along the axial length of the tip shroud 200. The radially-aligned contact surfaces include surfaces that are substantially aligned in the radial direction. For example, in a preferred embodiment, a radially-aligned contact surface may be a surface within +/−10 degrees of a radial reference line.

According to embodiments of the present application, the tip shroud 200 also may include a substantially non-radially-aligned second contact surface that is formed via a protrusion from the tip shroud 200, which herein is referred to as a "damping fin 204." The damping fin 204 may include a fin or tab type protrusion that extends substantially both circumferentially and axially from either the leading or trailing edge of the tip shroud 200. As shown, in some embodiments, the damping fin 204 may have a relatively narrow or thin profile. Also, in some embodiments (not shown in FIGS. 6 and 7), as discussed in more detail below, the damping fin 204 may extend or slope in a radial direction as well. In those type of embodiments, as defined in more detail below, the extent of the damping fin 204 radial slope will be substantially less steep than the radially aligned contact surface 202 described above.

In a preferred embodiment, as shown in FIG. 6, one of the damping fins 204 may be located on the leading edge of the tip shroud 200, and, as shown in FIG. 7, another damping fin 204 may be positioned on the trailing edge of the tip shroud 200. Further, as shown the preferred exemplary embodiment of FIGS. 6 and 7, the leading edge damping fin 204 may be located on the pressure side of the tip shroud 200, and the trailing edge damping fin 204 may be located on the suction side of the tip shroud 200, though, other configurations, as explained in more detail below, are also possible. The damping fins 204 on the leading and trailing edges of the tip shroud 200 may be configured to correspond with each other. As used herein, damping fins "corresponding" is intended to mean that when a set of rotor blades having tip shrouds of the same design are properly installed in a rotor disk of a turbine engine, the damping fin 204 positioned on the leading edge of the tip shroud 200 of a first rotor blade (i.e., a "leading edge damping fin") resides in a desired position in relation to the damping fin 204 positioned on the trailing edge of the tip shroud 200 of a second rotor blade (i.e., a "trailing edge damping fin") that trails the first rotor blade. Likewise, damping fins "corresponding" also means that the trailing edge damping fin 204 of the first rotor blade resides in a desired position in relation to the leading edge damping fin 204 of a third rotor blade that leads the first rotor blade. In some environments, the corresponding damping fins 204 may engage each other. In other embodiments, the corresponding damping fins 204 may reside in close proximity to each other.

As also depicted in FIGS. 6 and 7, the radial position of the leading edge damping fin 204 and the trailing edge damping fin 204 may be offset slightly so to produce the desired level of contact or proximity between the corresponding trailing edge damping fin and the leading edge damping fin during operation. In this manner, the corresponding damping fins 204 may reside in close radial position to each other and, having similar size and shape, may be configured such that the corresponding damping fins 204 of neighboring rotor blades substantially overlap each other axially and circumferentially. The extent of the radial offset may determine the amount of contact made during operation. In one preferred embodiment, the radial offset is configured such that the contact surfaces of corresponding damping fins 204 touch or engage each other. In another preferred embodiment, the radial offset is configured such that the contact surfaces of corresponding damping fins 204 do not touch each other when they turbine is "cold" or during engine startup (i.e., a startup phase), but make regular contact as the engine warms during operation thereafter. In another preferred embodiment, the radial offset is configured such that the contact sources of corresponding damping fins 204 do not touch each other when the turbine engine is "cold" or during engine startup, but make partial contact as the engine warms during operation. In still another preferred embodiment, the radial offset is configured such that the contact surfaces of corresponding damping fins 204 make partial contact when the turbine engine is "cold" or during engine startup, but make relatively constant contact as the engine warms during operation.

As shown in FIGS. 6 and 7, in one preferred embodiment, the trailing edge damping fin 204 may be positioned just outboard of the leading edge damping fin 204. In this configuration, as one of ordinary skill in the art will appreciate, a contact face is formed on the outer radial surface of the leading edge damping fin 204. And, a contact face is formed on the inner radial surface of the trailing edge damping fin 204. In some embodiments, such contact faces may be provided with enhanced wear properties to prolong the life of the part. For example, the contact face may be provided with a wear coating or more durable material. In one preferred embodiment, the contact faces are formed with a cobalt-based hardfacing powder. It will be appreciated that, as described above, the damping fins 204 may be configured such that during turbine engine operation, the outer radial surface of the leading edge damping fin 204 and the inner radial surface of the trailing edge damping fin 204 of adjacent turbine blades make at least partial contact. This contact, as one of ordinary skill in the art will appreciate, generally mechanically dampens some of the vibration being experienced by the rotor blades.

The damping fin 204 may have an approximate rectangular shape that includes somewhat rounded corners, as shown. Other shapes are possible, including semicircular. Further, while a preferred embodiment is shown in FIGS. 6 and 7, other arrangements and configurations are possible. For example, in another preferred embodiment, the leading edge damping fin may be positioned on the suction side of the tip shroud and the trailing edge damping shroud may be positioned on the pressure side of the tip shroud. In addition, the leading edge damping fin, instead of being positioned inboard, may be position outboard of the trailing edge damping fin. In still a further embodiment, the trailing edge damping fin may include fins on both the pressure side and suction side of the tip shroud, and the leading edge damping fins may include damping fins that correspond to these on both the pressure side and suction side of the tip shroud. In this instance, the leading edge damping fins may be inboard, outboard, or both inboard and outboard in relation to the corresponding trailing edge damping fins. More particularly, in one embodiment, one of the leading edge damping fins may be inboard of a corresponding trailing edge damping fin, while the other leading edge damping fin is outboard of the corresponding trailing edge damping fin. In some applications, this interlocking configuration may provide enhanced damping characteristics.

In the example illustrated in FIGS. 6 and 7, the damping fins 204 are configured such that the fins extend primarily circumferentially and axially. That is, the damping fins 204 form an angle with the radial direction of the turbine engine of approximately 90 degrees, and, accordingly, as shown, the damping fins 204 form an angle with the axial direction and the circumferential direction of the turbine engine of approximately 0 degrees. In some embodiments, this angle or slope may be adjusted or tuned to increase the damping of a single vibration mode or several different vibration modes that might be particularly troublesome or heretofore unaffected by other conventional damping efforts, as one of ordinary skill in the art will appreciate. In this manner, the secondary contact surface, i.e., the damping fin 204, may be designed to provide damping for a vibration mode that might not have been adequately addressed by a conventional radially-aligned damping contact surface.

Figure 8:
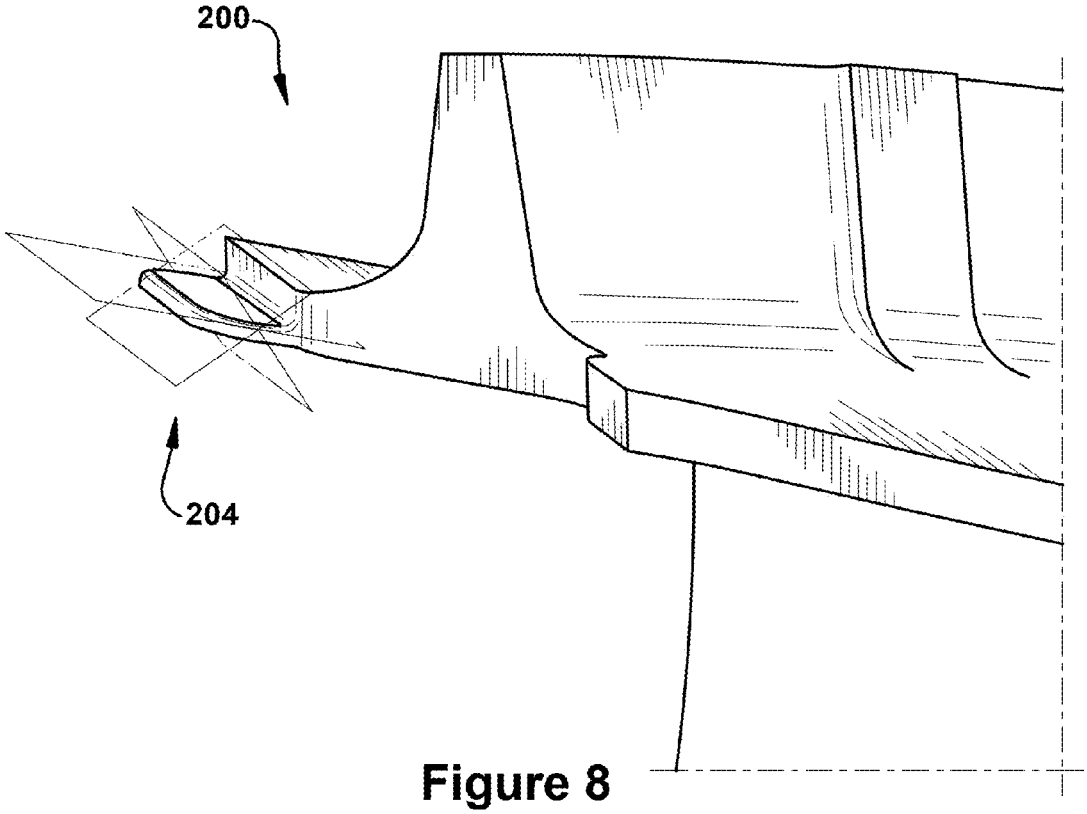
FIG. 8 is a perspective view of the leading edge of a turbine engine rotor blade having a tip shroud according to an exemplary embodiment of the present application and, more particularly, possible angular configurations for a damping fin according to the present application.

FIG. 8 illustrates how the angle of the damping fin 204 may be adjusted such that different vibration modes may be addressed. As shown, in one embodiment, this may be accomplished by rotating the damping fin 204 about an axis formed at the base of the damping fin, i.e., where the damping fin 204 protrusion connects to the tip shroud 200. In this manner, the modes of vibration that are dampened by the damping fin 204 may be manipulated in a desired manner. If one of the damping fins 204 is rotated, it will be appreciated that the corresponding damping fin 204 at the other edge of the tip shroud will be oppositely rotated to substantially the same angle. In this manner, the damping fins 204, being offset radially, may still make contact along a significant or substantially all of their respective contact surfaces. In another preferred embodiment, the configuration of damping fins includes at least one trailing edge damping fin on both the pressure side and suction side of the tip shroud and at least one leading edge damping fin on both the one pressure side and suction side of the tip shroud. In this case, each of leading edge damping fins corresponds to one of the trailing edge damping fins.

The angle of rotation of the damping fin 204 may vary depending on the application. The angle of rotation of the damping fin 204 may be identified generally by the angle the damping fin 204 makes with a radially oriented reference line. For example, in the embodiment shown in FIGS. 6 and 7, the damping fins 204 forms an angle with the radial reference line of approximately 90 degrees. In other preferred embodiments, the damping fins may form an angle with the radial reference line of between approximately 70 and 110 degrees. In other preferred embodiments, the damping fins may form an angle with the radial reference line of between approximately 60 and 120 degrees. In other preferred embodiments, the damping fins may form an angle with the radial reference line of between approximately 45 and 135 degrees. In still other preferred embodiments, the damping fins may form an angle with the radial reference line of between approximately 30 and 150 degrees.

From the above description of preferred embodiments of the invention, those skilled in the art will perceive improvements, changes and modifications. Such improvements, changes and modifications within the skill of the art are intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

We claim:

1. In a tip shrouded rotor blade for a turbine engine, a tip shroud comprising:

a plurality of damping fins, each damping fin comprising a substantially non-radially-aligned surface that is configured to make contact with a tip shroud of a neighboring rotor blade;

wherein:

the plurality of damping fins include a leading edge damping fin and a trailing edge damping fin;

the leading edge damping fin corresponds to the trailing edge damping fin;

the plurality of damping fins include at least one trailing edge damping fin on both the pressure side and suction side of the tip shroud and at least one leading edge damping fin on both the pressure side and suction side of the tip shroud; and each of the leading edge damping fins corresponds to one of the trailing edge damping fins.

2. The tip shroud according to claim 1, wherein the leading edge damping fin corresponding to the trailing edge damping fin comprises the leading edge damping fin and the trailing edge damping fin being configured such that when a set of rotor blades having tip shrouds of the same design are installed in a rotor disk of the turbine engine:

the leading edge damping fin of a first rotor blade resides in a desired damping position in relation to the trailing edge damping fin of a second rotor blade that directly leads the first rotor blade; and the trailing edge damping fin of the first rotor blade resides in a desired damping position in relation to the leading edge damping fin of a third rotor blade that directly trails the first rotor blade.

3. The tip shroud according to claim 1, wherein the radial position of the leading edge damping fin is offset from the radial position of the trailing edge damping fin such that a desired level of contact between the leading edge damping fin and the trailing edge damping fin is substantially maintained during operation of the turbine engine.

4. The tip shroud according to claim 3, wherein a desired level of contact comprises one of:

substantially partial contact during a startup phase for the turbine engine and substantially constant contact thereafter;

substantially partial contact during the startup phase for the turbine engine and substantially partial contact thereafter;

substantially no contact during the start-up phase for the turbine engine and substantially constant contact thereafter; and substantially no contact during the start-up phase for the turbine engine and substantially partial contact thereafter.

5. The tip shroud according to claim 1, further comprising one or more radially-aligned contact surfaces;

wherein:

the radially-aligned contact surfaces comprise surfaces that are substantially aligned in the radial direction and configured to make contact with the tip shroud of neighboring rotor blades;

the radially-aligned contact surfaces at the leading edge of the tip shroud each correspond to the radially-aligned contact surfaces at the trailing edge of the tip shroud; and the radially-aligned contact surfaces comprise contact surfaces that form an angle with a radial reference line of between approximately +/−10 degrees.

6. The tip shroud according to claim 1, wherein:

the non-radially-aligned contact surfaces comprise contact surfaces that form an angle with a radial reference line of between approximately 10 and 170 degrees; and the damping fin comprises a relatively thin protrusion that extends circumferentially and axially from an edge of the tip shroud.

7. The tip shroud according to claim 1, wherein either:

the leading edge damping fin is disposed on a pressure side of the tip shroud and the trailing edge damping fin is disposed on a suction side of the tip shroud; or the leading edge damping fin is disposed on a pressure side of the tip shroud and the trailing edge damping fin is disposed on a suction side of the tip shroud.

8. The tip shroud according to claim 1, wherein:

the trailing edge damping fin comprises a radial position just outboard of the leading edge damping fin;

an outer radial surface of the leading edge damping fin comprises a first contact face and an inner radial surface of the trailing edge damping fin comprises a second contact face; and at least one of the first contact face and the second contact face comprise a wear coating.

9. The tip shroud according to claim 8, wherein the wear coating comprises cobalt-based hardfacing powder.

10. The tip shroud according to claim 8, wherein the damping fins are configured such that during turbine engine operation the outer radial surface of the leading edge damping fin and the inner radial surface of the trailing edge damping fin of adjacent turbine blades make at least partial contact.

11. The tip shroud according to claim 1, wherein the leading edge damping fin and the trailing edge damping fin each comprise one of rectangular shape and a semicircular shape.

12. The tip shroud according to claim 1, wherein:

the leading edge damping fin comprises a radial position just outboard of the trailing edge damping fin; and an inner radial surface of the leading edge damping fin comprises a first contact face and an outer radial surface of the trailing edge damping fin comprises a second contact face.

13. The tip shroud according to claim 1, wherein at least one of the leading edge damping fins comprises an outboard position in relation to at least one of the corresponding trailing edge damping fins; and wherein at least one of the leading edge damping fins comprises an inboard position in relation to at least one of the corresponding trailing edge damping fins.

14. The tip shroud according to claim 1, wherein the damping fins form an angle with the radial reference line of 90 degrees.

15. The tip shroud according to claim 1, wherein the damping fins form an angle with the radial reference line of between 70 and 110 degrees.

16. The tip shroud according to claim 1, wherein the damping fins form an angle with the radial reference line of between 60 and 120 degrees.

17. The tip shroud according to claim 1, wherein the damping fins form an angle with the radial reference line of between 45 and 135 degrees.

18. The tip shroud according to claim 1, wherein the damping fins form an angle with the radial reference line of between 30 and 150 degrees.

* * * * *